United States Patent [19]

Strybel

[11] Patent Number: 4,813,260

[45] Date of Patent: Mar. 21, 1989

[54] MULTIPURPOSE TUBE WORKING TOOL

[75] Inventor: Richard V. Strybel, Elk Grove Village, Ill.

[73] Assignee: Clevite Industries Inc., Cleveland, Ohio

[21] Appl. No.: 45,797

[22] Filed: Apr. 27, 1987

[51] Int. Cl.[4] ..... B21D 41/02

[52] U.S. Cl. ..... 72/316; 72/460; 269/164

[58] Field of Search ..... 72/316–318, 72/125, 116, 115, 460; 269/43, 268, 164, 240

[56] References Cited

U.S. PATENT DOCUMENTS

| | | | |
|---|---|---|---|
| 207,349 | 8/1878 | Dutton | 269/164 |
| 724,091 | 3/1903 | Fisher | 269/240 |
| 800,604 | 9/1905 | Anderson | 269/164 |
| 1,976,878 | 10/1934 | Eden | 269/164 |
| 2,124,743 | 7/1938 | McMahon . | |
| 2,132,947 | 10/1938 | Gagne . | |
| 2,242,831 | 5/1941 | McIntosh . | |
| 2,314,221 | 3/1943 | Kellems . | |
| 2,442,224 | 5/1948 | Vaill | 72/317 |
| 2,526,210 | 10/1950 | Edelmann . | |
| 2,532,250 | 11/1950 | Watts . | |
| 2,774,408 | 12/1956 | Franck . | |
| 2,797,726 | 7/1957 | Granville | 72/322 |
| 3,027,931 | 4/1962 | Franck . | |
| 3,044,530 | 7/1962 | Jones | 72/116 |
| 3,044,531 | 7/1962 | Wilson . | |
| 3,059,686 | 10/1962 | Franck | 72/317 |
| 3,073,375 | 1/1963 | Franck . | |
| 3,421,354 | 1/1969 | Strybel et al. . | |
| 3,913,364 | 10/1975 | Strybel | 72/318 |
| 3,959,998 | 6/1976 | Ross | 72/317 |

*Primary Examiner*—Daniel C. Crane

*Attorney, Agent, or Firm*—Russell E. Baumann

[57] ABSTRACT

A tube working tool having a pair of jaws each provided with a single semicylindrical tube receiving recess. The tool includes a yoke defining a pair of spaced jaw supports and a carrier support spaced from and centered betwen the jaw supports. A carrier is threadedly mounted to the carrier support and provided with any one of a plurality of different tube working heads at its lower end for working the end of a tube retained by a pair of clamping jaws carried on the jaw supports. The clamping jaws are clamped against a back wall of the yoke by a pair of screws extending through the jaws at opposite sides of the tube clamping recesses. Cooperating structure is provided on the inboard jaw and jaw support for retaining the inboard jaw against displacement.

7 Claims, 1 Drawing Sheet

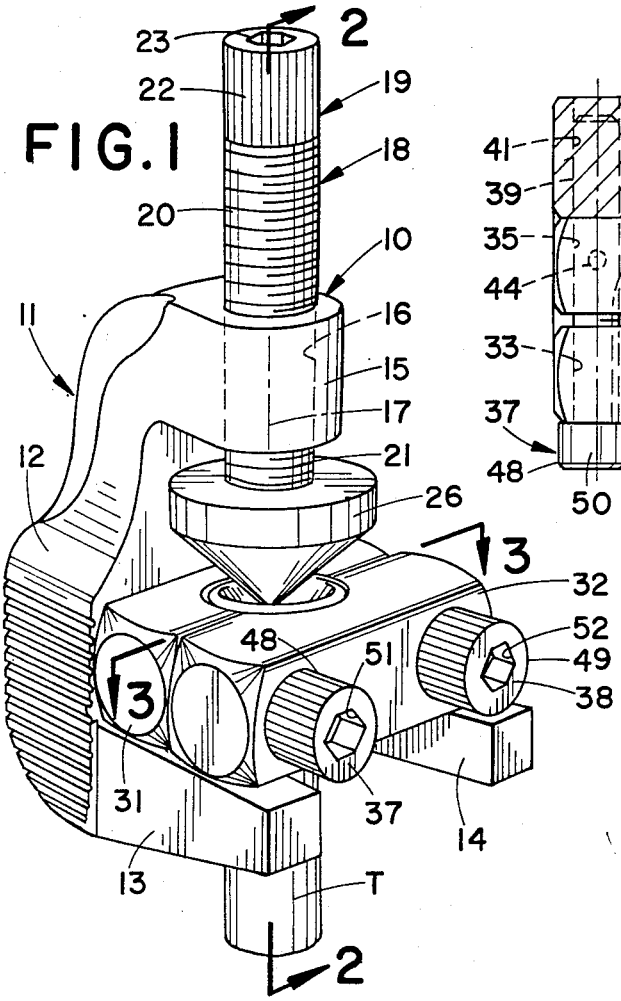
FIG. 1
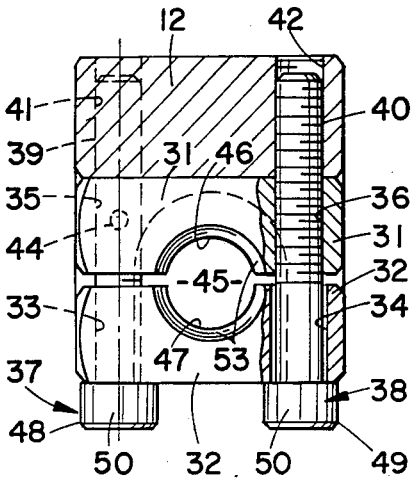
FIG. 3
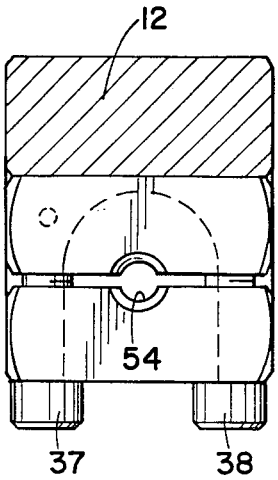
FIG. 4
FIG. 5
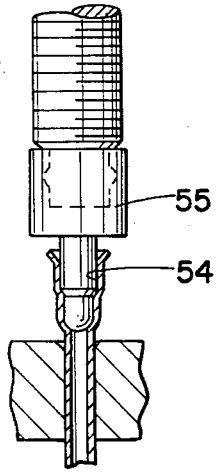
FIG. 6
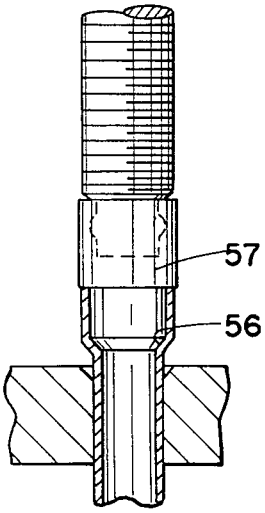
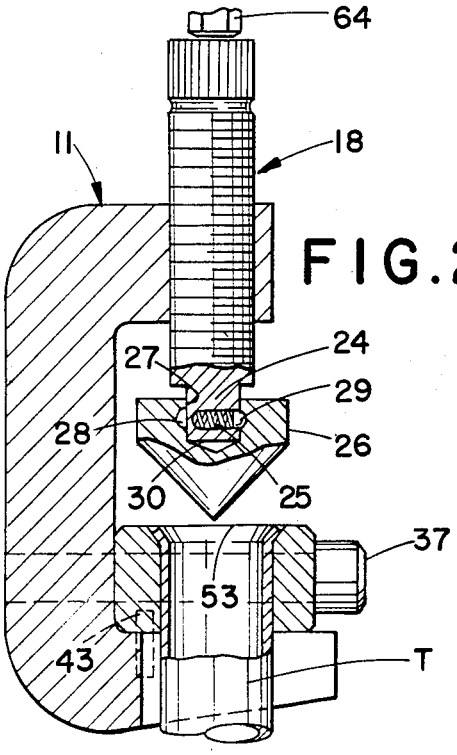
FIG. 2
FIG. 7
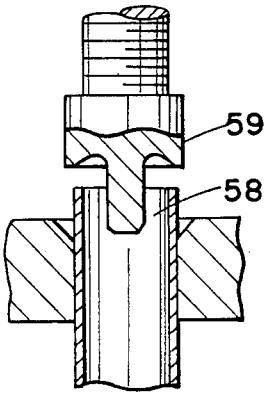
FIG. 8
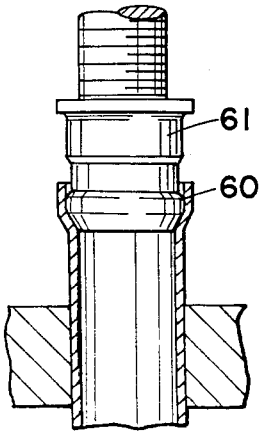

MULTIPURPOSE TUBE WORKING TOOL

TECHNICAL FIELD

This invention relates to tube working tools and in particular to manually operable multipurpose tools such as for flaring, double flaring and swaging tubing.

BACKGROUND OF THE ART

In the conventional manually operable tube flaring tool a pair of jaws is mounted to a yoke so as to dispose tube clamping means thereof in axial alignment with a flaring head mounted to a threaded carrier. Means are provided for rotating the carrier which is threaded through a portion of the yoke of the tool so as to move selectively toward and from the tube and to effect the desired tube working operation and retraction of the working tool from the tube end upon completion of the working operation.

One form of conventional tube clamping means comprises a pair of clamp bars having a plurality of different size recesses therein for clamping any one of a plurality of different size tubes by selectively positioning the clamping bars in the yoke portion of the tool. It has been found, however, that the user frequently only requires one or at the most a small number of different tube clamping means and thus the bulky tube clamping bars provide unnecessary additional capabilities.

DISCLOSURE OF THE INVENTION

The present invention comprehends an improved tube working tool which permits the user to select any one of a plurality of different sets of tube clamping elements corresponding to the diameter of the tube to be worked with each pair of elements being adapted to clamp only a single size tube.

The tool of the present invention is extremely compact and permits facilitated working of the tube therein.

The tube clamping jaws are made to be no larger than the width of the body of the tool whereby the body may be secured in a vice during the tube working operation.

The tube working element may be selectively removably installed on the carrier of the tool whereby any one of a number of different types of tube working elements may be utilized including flaring heads of both 37° and 45° angles, double flaring head, and swaging heads.

The user need acquire only the proper size and type of clamping jaws and tube working elements as desired at a given time thus minimizing the cost to the user while yet permitting use of the tool with a wide range of tubing sizes and different working operations selectivity.

The invention further comprehends the provision of a carrier utilizing a socket recess adapted to receive the socket head of a conventional ratchet wrench. The elimination of transversely projecting manipulating means in permanent association with the carrier provides for facilitated tube forming.

The permissible use of the conventional ratchet wrench permits rotation of the carrier with minimal angular movement of the manipulating wrench.

In the illustrated embodiment, the jaws are retained to the yoke by a pair of screws extending through the jaws and threaded to a back wall portion of the yoke. A pair of support legs project forwardly from a lower portion of the back wall to support the jaws against the downward force generated by the working tool during the working operation.

The outboard jaw may be provided with a through bore which is slightly larger than the outer diameter of the clamping screw, and the inboard jaw urged against the back wall of the yoke when the tube is clamped in the tool is provided with a through bore having a diameter substantially equal to the outer diameter of the screw.

The back wall may be provided with threaded through bores for threadedly receiving the clamping screws.

Means are provided on the yoke for locating the inboard jaw and retaining the inboard jaw against lateral displacement as well as outward movement away from the back wall when the outboard jaw is moved away from the formed tube upon completion of the working operation. In the illustrated embodiment, this means comprises a pin on one of the jaw support legs snugly received in a recess in the inboard jaw.

The clamping screws, in the illustrated embodiment, comprise socket head screws having sockets similar to the socket of the carrier, whereby a single socket head wrench may be utilized for manipulating the clamping screws as well as the carrier.

The clamping screws are located immediately adjacent the tube clamping recesses of the jaws for minimizing deflection and simplified manufacture of the tool.

The arrangement permits a large clamping force to be applied by means of the relatively long lever arm supported by the conventional ratchet wrench.

The compact yoke construction provides multipoint load distribution, permitting low cost manufacture, such as by die casting of lightweight material, such as aluminum.

The light weight of the tool facilitates hand operation and improved production of handheld tubing flares.

The invention further comprehends the use of low cost antirotation means for locking high strength threaded inserts in the yoke.

The carrier and clamping screws may be provided with knurled distal ends for facilitated hand manipulation thereof, with free travel movement in advancing and retracting these elements to and from the working arrangement.

The multipurpose tube working tool of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a multipurpose tube working tool embodying the invention;

FIG. 2 is a fragmentary vertical section taken substantially along the line 2—2 of FIG. 1;

FIG. 3 is a horizontal view partially in section taken substantially along the line 3—3 of FIG. 1;

FIG. 4 is a horizontal section generally similar to that of FIG. 3 but illustrating the use of a different size set of jaws;

FIGS. 5–8 are fragmentary vertical sections illustrating the use of different working tools in association with different complementary jaw pairs illustrating the versatility of the tube working tool of the invention.

BEST MODE FOR CARRYING OUT THE INVENTION

In the illustrative embodiment of the invention as disclosed in the drawing, a multipurpose tube working tool generally designated 10 is shown to comprise a yoke 11 having a back wall 12, a air of spaced jaw supports 13 and 14 projecting forwardly from the back wall, and a carrier support 15 projecting from the back wall in overlying spaced relationship to the jaw supports and having a threaded through bore 16 defining an axis 17 centered between the spaced jaw supports 13 and 14.

A carrier 18 is provided with an upper manipulating hand 19, a threaded midportion 20 threaded to threaded bore 16 of the carrier support, and a lower end 21 disposed intermediate the carrier support and the jaw supports 13 and 14.

Upper end 19 of the carrier defines a knurled circumferential portion 22 for fingertip manipulation of the carrier by the user. A hex socket recess 23 is provided in end 19 opening axially outwardly to receive the socket head 24 of a conventional ratchet-type socket wrench for forceful movement of the carrier during a tube working operation.

Lower end 21 of the carrier is provided with a reduced diameter distal end 24 having a radially outwardly opening recess 25. Means are provided for releasably retaining on the carrier end 24 any one of a plurality of different working tools, such as flaring head 26. As shown in FIG. 2, the working tools may be provided with a complementary upwardly opening recess 27 having an annular radially inwardly opening recess 28 receiving a retaining ball 29 urged thereinto by a suitable coil spring 30 within the retainer recess 25.

Thus, any one of a plurality of different size and/or function working tools may be removably installed on the carrier for working tubes T in the working tool.

As illustrated in FIGS. 1 and 2, a tube to be worked may be retained in axially aligned relationship with the carrier and, thus, with the working head, such as flaring head 26, by means of a pair of clamping jaws 31 and 32. The clamping jaws may comprise any one of a plurality of pairs of clamping jaws adapted to hold different size tubes and for different working operations thereon. The jaws are supported at their opposite ends on the jaw supports 13 and 14 against the forces generated by the advancing tube working tool during the working operation. Outboard jaw 32 defines a pair of through bores 33 and 34 and inboard jaw 31 defines a pair of through bores 35 and 36 aligned with bores 33 and 34 when the jaws are disposed on the jaw supports 13 and 14 in tube clamping association.

A pair of retaining screws 37 and 38 are provided having threaded portions 39 and 40, respectively, threaded into threaded through bores 41 and 42 in yoke back wall portion 12. Bores 33 and 34 have a diameter preferably slightly larger than the outer diameter of the retaining screws so as to permit the threaded portion to pass freely therethrough into threaded association with the yoke back wall. Bores 35 and 36 of the inboard jaw are preferably similar in diameter to the outer diameter of the retaining screws.

Inboard jaw 31 is retained against lateral displacement by a pin 43 press-fitted into the jaw support 13 to project upwardly therefrom into a complementary recess 44 in the lower surface of jaw 31. The cooperating pin and recess means not only prevents lateral displacement of the inboard jaw but further prevents movement of the inboard jaw outwardly upon completion of a tube working operation when the outboard jaw 32 is moved away from the inboard jaw to release the worked tube from the tool.

Further, as a result of the correspondence of the diameter of the inboard jaw bores 35 and 36 to the outer diameter of the retaining screws, the outboard jaw is automatically approximately centered relative to the tube receiving space 45 coaxially of the carrier axis 17 when the retaining screws are passed sequentially through the outboard jaw 32 and inboard jaw 31 into threaded association with the yoke back wall.

Each of the jaws is provided with a tube receiving recess, such as semicylindrical recess 46 in jaw 31, and semicylindrical recess 47 in jaw 32 adapted to receive the tube T for clamping the tube between the jaws upon tightening of the retaining screws 37 and 38. As shown, the retaining screws are provided at their distal outer ends with heads 48 and 49, respectively, which may be peripherally knurled, as at 50, for facilitated fingertip threading of the retaining screws to and from the clamping arrangement.

Forceful clamping of the jaws about the tube T is effected by engagement of a suitable tool, such as the socket head 64 of a ratcheting wrench, with suitable hex socket recesses 51 and 52 in the screw heads 48 and 49, respectively.

As the bores 33 and 34 of the outboard jaw 32 are slightly larger than the outer diameter of the retaining screw threaded portion, the outboard jaw may be suitably accurately positioned relative to the tube so as to prevent cocking and to assure accurate clamped engagement of the jaws relative to the tube in the tube working operation.

As best seen in FIG. 3, the jaw bores 33, 34, 35 and 36 are disposed closely adjacent the tube receiving recesses 46 and 47, thereby minimizing deflection, minimizing overall size of the tool, and simplifying and reducing cost of manufacture. Further, by utilizing the same size socket recesses in the carrier and retaining screws, the use of a conventional socket head ratchet wrench with a single socket head mounted thereto is permitted for further facilitating the tube working operation.

Each of the semicylindrical tube receiving recesses of the jaws may be provided with a suitable end surface, such as chamfer 53 for cooperation with the selected tube working tool, such as flaring head 26, in the embodiment of FIGS. 1–4. As will be obvious to those skilled in the art, other suitable working recesses may be provided for cooperation with corresponding other forms of working tools, such as recess 54 and working tool 55, providing a swaged tube end, as shown in FIG. 5, recess 56 and working tool 57 providing a swaged tube end in a larger diameter tube, as illustrated in FIG. 6, recess 58 and working tool 59 for providing first stage of a double-flared tube end, as shown in FIG. 7, and recess 60 and tool 61 for providing a swaged tube end of larger diameter, as shown in FIG. 8. The recesses and tools of FIGS. 5–8 are exemplary only, it being obvious to those skilled in the art that any suitable combination of tube working recesses and tube working tool heads may be utilized in the flaring tool 10 within the scope of the invention.

The releasable tool head retaining means 28, 29, 30 permits facilitated change of the tool head as desired by the user. Thus, different sets of clamping jaws may be utilized with the selected tube working heads, as desired by the user.

Thus the tool 10 comprises a multipurpose tool permitting different types of working on different types and sizes of tubing. The invention comprehends supporting a pair of clamping dies on supports integral with the tool yoke and retaining the clamping dies in clamping association with the tube to be worked by clamping screws clamping the dies to a back wall portion of the yoke of the tool.

The specific clamping jaws, or forming dies, appropriate for working a desired tube may be selected for use with the appropriate working tool head which, in turn, may be removably mounted to the carrier, permitting selective installation of different working tool heads in the tool as desired.

The clamping jaws are made to be no larger than the yoke, permitting the yoke to be clamped in a vice when desired, although the tool is normally intended for use in handheld tube working operations. The yoke may be formed of relatively lightweight material, such as die-cast aluminum, and is extremely compact.

By permitting the use of the conventional socket head ratchet wrench, facilitated tube working is obtained with the minimal amount of angular movement of the clamp tightening and head rotating means.

By providing cooperating locating means on the yoke and inboard jaw, facilitated use of the tool is obtained.

Because of the adjacency of the screws to the clamping bores, deflection of the jaws is effectively minimized, permitting the recesses to be effectively 180° and slightly undersize relative to the intended tube to be clamped, such as approximately 0.005" to 0.010" undersize. Thus, the tube is effectively retained in the clamping jaws against the substantial tube working forces generated in the working operation without deflection of the jaws and, thus, with maintained accurate axial alignment with the tube working head.

The foregoing disclosure of specific embodiments is illustrative of the broad inventive concepts comprehended by the invention.

I claim:

1. A tube working tool comprising:

a yoke having a back wall, a pair of spaced jaw supports projecting forwardly from said back wall, and a carrier support projecting from said back wall in overlying spaced relationship to said jaw supports and having a threaded through bore axially centered between said jaw supports;

a carrier having an upper manipulating end, a threaded midportion threaded to said carrier support in said through bore, and a lower end disposed intermediate said carrier support and jaw supports;

a first jaw having a single semicylindrical tube receiving recess;

a second jaw having a single semicylindrical tube receiving recess complementary to said first jaw recess;

a pair of retaining screws extending through said jaws and threaded to said yoke back wall comprising means for independently adjustably forcibly urging said jaws toward said back wall with said tube receiving recesses thereof aligned to clamp there in a tube to be worked in axially centered relationship to said carrier support bore; and working means on said carrier for working the end of the tube clamped in said jaws, said first jaw being provided with a pair of parallel through bores at opposite sides of said tube receiving recess thereof, each said bore having a diameter similar to the outer diameter of said screws extending therethrough, and said second jaw being provided with a pair of parallel through bores aligned with said through bores of said first jaw and having a diameter greater than the outer diameter of said screws to permit lateral adjustment of said second jaw in accommodating the semicylindrical recess thereof to the tube being clamped, said yoke comprising means for supporting said second jaw for free lateral movement transversely to the longitudinal extent of said bores thereof whereby said second jaw is accurately positioned on said screws to have the tube receiving recess thereof positioned accurately coaxially of said carrier bore as a result of independent threaded advance of said retaining screws into said yoke back wall.

2. The tube working tool of claim 1 where in said yoke defines opposite side surfaces, said jaws having a length no greater than the spacing of said side surfaces.

3. The tube working tool of claim 1 wherein said screws and said carrier manipulating end define similar tool engaging means rotation of said carrier in effecting a tube working operation and for threading of said socket head screws.

4. The tube working tool of claim 1 wherein said working means comprises any one of a plurality of different working means and said carrier lower end is provided with spring-biased means for selectively releasably retaining any one of said working means to said carrier.

5. The tube working tool of claim 1 wherein cooperating means are provided on said yoke and the jaw juxtaposed to said back wall for locating the semicylindrical tube clamping recess of the jaw coaxially of said carrier support through bore and preventing movement of that jaw away from said back wall upon retraction of the other jaw of the pair away from said back wall to release the worked tube from between said jaws upon completion of a working operation.

6. The tube working tool of claim 5 where in said cooperating means comprises a pin on said yoke and a recess in said first jaw for receiving said pin.

7. The tube working tool of claim 1 wherein means are provided on said yoke and one of said jaws retaining said one jaw against displacement from said yoke as a result of the other of said jaws being displaced from said yoke.

* * * * *